United States Patent [19]

Benéteau

[11] 4,445,289

[45] May 1, 1984

[54] PLASTIC SPIKE FOR SPORTS SHOE

[75] Inventor: Charles Benéteau, Pouzauges, France

[73] Assignee: Patrick S.A., France

[21] Appl. No.: 385,797

[22] Filed: Jun. 7, 1982

[30] Foreign Application Priority Data

Jun. 23, 1981 [FR] France ..... 81 12329

[51] Int. Cl.[3] ..... A43C 15/16

[52] U.S. Cl. ..... 36/134; 36/67 D; 36/67 R; 36/59 R

[58] Field of Search ..... 36/59 R, 61, 62, 65, 36/67 R, 67 A, 67 D, 134

[56] References Cited

U.S. PATENT DOCUMENTS 1,985,775 12/1934 Goldenberg ..... 36/67 D
2,187,621 1/1940 Hanus ..... 36/61
4,357,763 11/1982 Fleischmann et al. ..... 36/134

FOREIGN PATENT DOCUMENTS 534628 5/1920 France ..... 36/67 D

*Primary Examiner*—Werner H. Schroeder
*Assistant Examiner*—Steven N. Meyers
*Attorney, Agent, or Firm*—Bacon & Thomas

[57] ABSTRACT

A spike, preferably made entirely of plastic material, for a sport shoe having a tapping in the sole thereof, the spike including a head portion which is capable of being rotated for locking same onto the tapping, a threaded stem extending from the head portion for engagement within the tapping, and the threaded stem being provided with a blind axial conduit for engagement by a spanner of corresponding configuration upon breakage of the spike and exposure of the blind end of the conduit.

3 Claims, 2 Drawing Figures

PLASTIC SPIKE FOR SPORTS SHOE

The present invention relates to a spike made, preferably entirely from plastic material, for a sports shoe, such as a football, rugby or similar shoe.

Such spikes normally comprise a head provided with means permitting to lock it in rotation and extended by a threaded stem, said latter is designed to be screwed into a blind tapping of the sole until the shoulder of said head rests forcibly against the inner face of said sole, which tapping can be molded in with said sole which, in this case, is advantageously provided with a projecting boss forming the start of a spike, or said tapping can be the tapping of a metallic insert embedded in the sole when said sole is molded.

It may happen that the player has to remove the spikes from his shoes if these are worn, or if he judges that they should be replaced by others, better adapted to the ground on which he has to run or play. And it can happen that when he does, the spikes break on the level of the head, which is frequently happening during play.

Whatever the reason for it, when a spike breaks the threaded stem of the spike stays inside the tapping; said stem does not project out and it is very difficult to remove it. Generally, the player has to return the shoes to the shop where he has bought them, to have the stem removed either on the spot or by the manufacturers. This obviously entails a delicate and relatively long repair which means that the shoes cannot be used for some time and proves, both for the manufacturer and the retailer, a high expense which up to now has been unavoidable.

It is the object of the present invention to improve these spikes by making the removal of the stem, when this has broken close to the sole, easy, rapid and feasible, by the player himself on the playing field. Concomitantly, this improvement enables to improve the actual quality of the molded spike.

According to the present invention, the threaded stem of the spike defines a blind axial conduit of polygonal cross-section, complementary to that of a spanner, which comes in to use if the spike breaks, by insertion into the now liberated blind end of the conduit of the threaded stem embedded in the tapping of the sole proper, or of a metallic insert thereof.

According to one particularly advantageous embodiment of the invention, the blind end of the conduit is situated level with the shoulder of the head or slightly inside it; the free end of the conduit issues onto the outside by way of a chamfered part, forming a tight support for a lug of the mold, provided for centering the spike, when said spike is molded over the sole.

Figure 1:
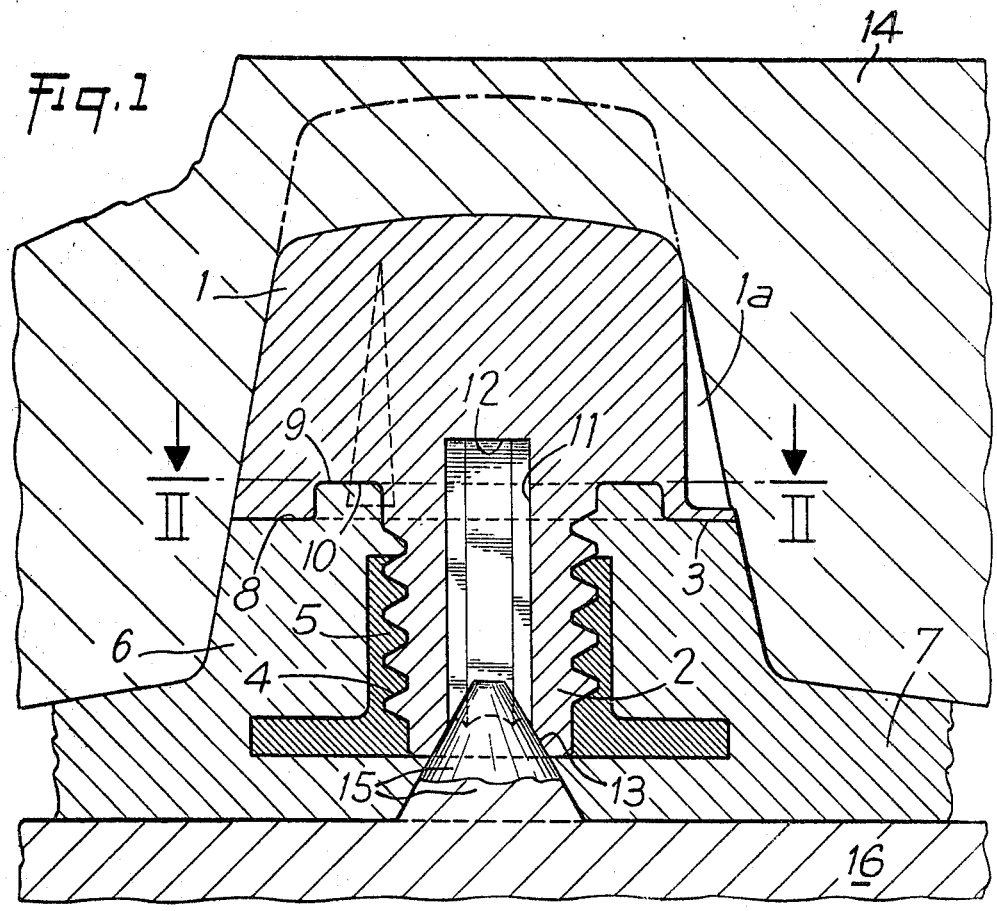
Figure 2:
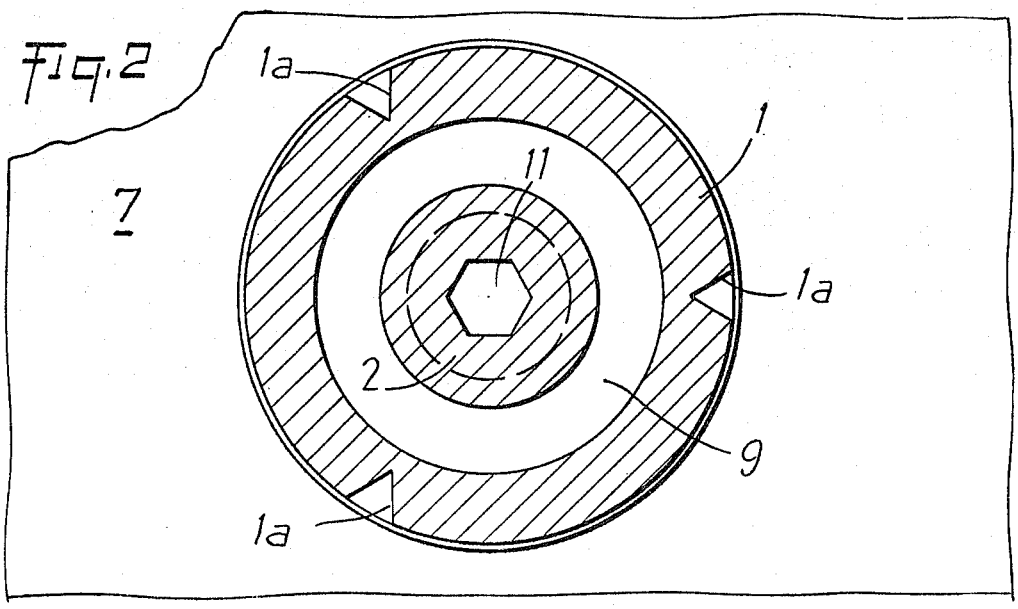

The invention will be more readily understood on reading the following description with reference to the accompanying drawings in which:

FIG. 1 shows part of a cross-section, on a large scale of a spike according to the invention and the way it is mounted on a sole, FIG. 2 is a cross-section along line II—II of FIG. 1.

As shown in FIG. 1, the spike comprises a head portion 1 extended by a threaded stem 2 which projects beyond an annular bearing 3. Said threaded stem 2 is designed to be screwed into a tapping 4 provided in an insert in metal or plastic material 5, embedded in a boss 6 and forming an integral part therewith, said boss forming the start of the spike and being molded with the sole 7 of the shoe, so as to jut out from underneath said sole;

the metallic, plastic or other insert 5 is quite simply a flanged nut, fastening closely on the material constituting the sole, the tapping 4 of which is very solid and wear-resistant whatever the nature of the material which constitutes the sole and the suppleness of said sole. When the threaded stem 2 is screwed and locked into the tapping 4 of the insert 5 of the sole, the bearing surface 3 of the head 1 is pressed against the equally annular seat 8 of the boss 6; moreover, an annular groove 9, provided in the bearing surface 3 of the head around the stem 2 fits closely over a rim 10 of complementary shape, projecting from said boss. The head 1 is of course provided on its periphery, as on the periphery of any conventional spikes, with notches 1*a* for fitting in a hollow spanner.

According to the invention, a blind axial conduit 11 is provided inside the threaded stem 2 when the spike is molded; said conduit has a polygonal cross-section which is complementary to that of a spanner; such spanners, which are well-known for fitting in Allen-type screws, have a hexagonal section. But conduit 11 can of course have any other type of section, as long as such section is capable of transmitting the tightening or untightening torque.

The blind end 12 of the conduit 11 is situated level with the bottom of the groove 9 in head 1 or at only a small depth therein; indeed, it is important, on the one hand, that when the head 1 wears out, the conduit 12 does not become open to the outside and in doing so risks to fill up with earth or any other clogging material; on the other hand, if the spike breaks off, the head normally breaks on the level of the rim 10 and it is important then for the conduit to be opened on to the breaking surface in order to be able to introduce said spanner into said conduit.

Moreover, the free end of the conduit 11 issues on to the outside via a chamfered part 13. Said chamfered part is useful to produce the sole 7; indeed, the spikes which will equip that sole are screwed by their threaded stem into metal, plastic or other types of inserts; the head 1 of said spikes with said inserts is fitted into one half-mold 14, whereas the chamfered part 13 of the threaded stem of said spikes sealingly covers a lug 15 of the other corresponding half-mold 16, said lug being normally provided for centering the spike when the mold is closed before injection and molding of the sole; thus when the mold is closed, the injected material cannot infiltrate between the chamfered parts 13 and the lugs 15 and thus the inner conduits 11 of the spikes remain empty after stripping from the mold, holes are left in place of the lugs and said holes are closed off by an inner sole (not shown).

The spike according to the invention is extremely advantageous insofar as it is so readily removable whenever the head part breaks off; it suffices to use a spanner, which is sold with the shoes, and if lost can easily be replaced by any other spanners found in any tool kit.

Said spike is also advantageous by its quality which is superior to that of the conventional spikes and by its better resistance; indeed, when injection-molding a spike with solid threaded stem, cavities always form in the center and often bubbles which weaken considerably the joint between head and stem; now the conduit 11 permits, although this is not actually its primary function, to orient the cavities towards the empty space that it creates and in doing so, the molded material is always sound and homogeneous; this of course increasing the braking strength.

Contrary to what it seems, the spike is not weakened by the presence of the conduit since the latter is situated in the axis of the threaded shank, i.e. in an area which virtually has nothing to do with bending or torsional strength.

The invention is in no way limited to the description given hereinabove and on the contrary covers any modifications that can be made thereto without departing from its scope.

What is claimed is:

1. A spike, preferably made entirely of plastic material, for a sport shoe having securing means in the sole thereof, which spike comprises a head portion, means carried by the head portion for rotating the head portion to lock same onto the securing means, a threaded stem extending from the head portion for engagement within the securing means, and the threaded stem being provided with a blind axial conduit having a blind end and a free end, the axial conduit being of a polygonal cross-sectional configuration for engagement by a spanner of corresponding configuration upon breakage of the spike and exposure of the blind end.

2. The spike of claim 1 wherein the head portion includes a shoulder and the blind end of the conduit is disposed substantially level with or slightly inside the shoulder.

3. The spike of claim 1 wherein the free end of the conduit opens onto the outside of the stem and is provided with a chamfered portion for engaging a lug of a mold in which the sole of the shoe is molded to center the spike when the sole is molded thereover.

* * * * *